US007806475B2

(12) United States Patent
Coady

(10) Patent No.: US 7,806,475 B2
(45) Date of Patent: Oct. 5, 2010

(54) COMPACT BOOSTER SEAT

(76) Inventor: Ryan Thomas Coady, 1581 40th Ave NW., Salem, OR (US) 97304

( * ) Notice: Subject to any disclaimer, the term of this patent is extended or adjusted under 35 U.S.C. 154(b) by 99 days.

(21) Appl. No.: 12/108,714

(22) Filed: Apr. 24, 2008

(65) Prior Publication Data

US 2009/0267393 A1 Oct. 29, 2009

(51) Int. Cl.
*A47C 1/08* (2006.01)

(52) U.S. Cl. ..... 297/255; 297/219.12; 297/440.11

(58) Field of Classification Search ..... 297/254, 297/255, 440.11, 485, 219.12
See application file for complete search history.

(56) References Cited

U.S. PATENT DOCUMENTS 3,604,750 A * 9/1971 Doering ..... 297/485 X
3,992,028 A * 11/1976 Abe et al. ..... 297/254 X
5,499,860 A 3/1996 Smith et al.
5,516,193 A 5/1996 Simpson
5,810,437 A 9/1998 Sharpe
5,915,789 A 6/1999 Ponce de Leon, III
6,343,837 B1 2/2002 Gage
7,000,985 B2 2/2006 Belgarde
7,530,635 B2 * 5/2009 Schramek-Flye ..... 297/255 X
2004/0021353 A1 2/2004 Lozano et al.
2004/0207239 A1 10/2004 King
2005/0116518 A1 6/2005 Belgarde

FOREIGN PATENT DOCUMENTS

KR 20-1996-292 U 1/1996
KR 20-0204859 Y1 12/2000

* cited by examiner

*Primary Examiner*—Anthony D Barfield
(74) *Attorney, Agent, or Firm*—Jim Passé; Passé Intellectual Property, LLC

(57) ABSTRACT

Taught herein is a lightweight, compact, and easily carried booster seat for a child or a small adult to use with stadium seating. The child booster seat comprises a sheet of flexible material, such as fabric, that is attached to the stadium seating by a sleeve and hooks or straps.

10 Claims, 7 Drawing Sheets

COMPACT BOOSTER SEAT

COPYRIGHT NOTICE

A portion of the disclosure of this patent contains material that is subject to copyright protection. The copyright owner has no objection to the reproduction by anyone of the patent document or the patent disclosure as it appears in the Patent and Trademark Office patent files or records, but otherwise reserves all copyright rights whatsoever.

BACKGROUND OF THE INVENTION

1. Field of the Invention

The present invention relates to a lightweight, easy to carry booster seat for a child or a small adult, particularly suited for theater and sporting events.

2. Description of Related Art

Small children have difficulty seeing theatrical performances, movies, and sporting events while seated in the typical theater and stadium seats because they can not see over the seat in front of them. Further, these children are not properly supported in seating designed for adults, and can even slip out of their seats if they slouch or kneel, leading to possible injuries.

While booster seats are widely used to raise children above the adult's seats, most of them are bulky and awkward to carry. There are some collapsible seats known in the art, which are easier to transport than rigid booster seats. However, even these collapsible seats can be a burden to carry especially in heavy crowds often encountered at sporting events. Thus, a lightweight, compact, and easily carried booster seat is desirable.

BRIEF SUMMARY OF THE INVENTION

The present invention is a non-freestanding booster seat for use with a stadium seat, i.e., a seat of the type often used in theaters and stadiums. A stadium seat comprises a seating member, a backrest member, and a support, wherein the seating member folds up against the backrest member.

In a first embodiment of the booster seat that is especially suited to a stadium seat having a slatted backrest member, the means of attaching the sheet comprises two or more sets of straps. Each set of straps comprises two straps, wherein one strap passes over a slat in the backrest member and the other strap passes under the slat so that when the two straps are joined the seat is attached to the backrest member. The straps may be joined by any means known in the art such as tying or buckling. The back surface of the seat, at the bottom, is fitted with a sleeve capable of fitting around the outer edge of the seating member of the stadium seat when the stadium seat is in its folded position.

In a second embodiment that is substantially the same as the first embodiment except that the means of attaching the sheet to the backrest member of a stadium seat comprises one or more hooks affixed to the back of the sheet, at or near, it's top. This embodiment may be used with substantially all stadium seats.

DETAILED DESCRIPTION OF THE INVENTION

Figure 1A:
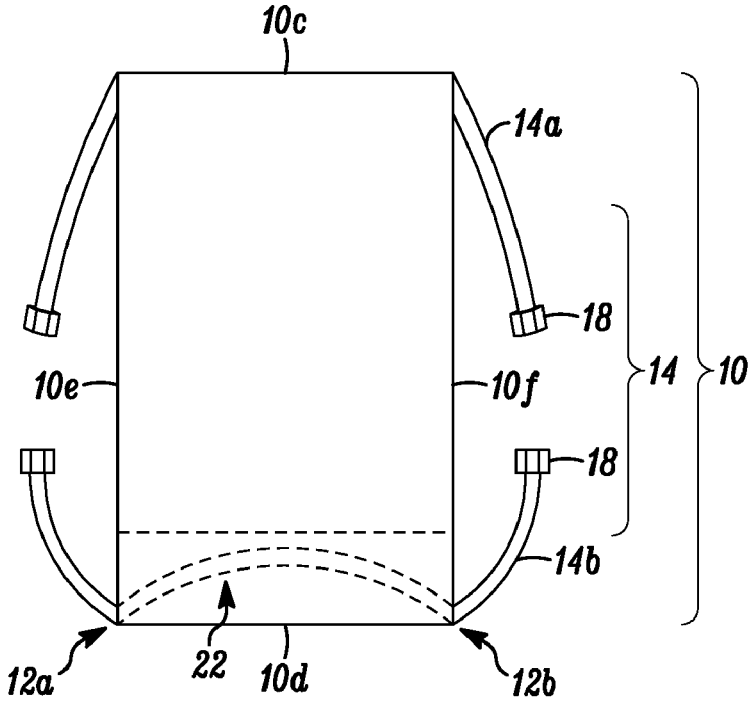
FIG. 1*a* shows the front of the first embodiment seat laying flat.

While this invention is susceptible of embodiment in many different forms, there is shown in the drawings and will herein be described in detail specific embodiments, with the understanding that the present disclosure of such embodiments is to be considered as an example of the principles and not intended to limit the invention to the specific embodiments shown and described. In the description below, like reference numerals are used to describe the same, similar or corresponding parts in the several views of the drawings. This detailed description defines the meaning of the terms used herein and specifically describes embodiments in order for those skilled in the art to practice the invention.

The terms "a" or "an", as used herein, are defined as one or more than one. The term "plurality", as used herein, is defined as two or more than two. The term "another", as used herein, is defined as at least a second or more. The terms "including" and/or "having", as used herein, are defined as comprising (i.e., open language). The term "coupled", as used herein, is defined as connected, although not necessarily directly, and not necessarily mechanically.

Reference throughout this document to "one embodiment", "certain embodiments", and "an embodiment" or similar terms means that a particular feature, structure, or characteristic described in connection with the embodiment is included in at least one embodiment of the present invention. Thus, the appearances of such phrases or in various places throughout this specification are not necessarily all referring to the same embodiment. Furthermore, the particular features, structures, or characteristics may be combined in any suitable manner in one or more embodiments without limitation.

The term "or" as used herein is to be interpreted as an inclusive or meaning any one or any combination. Therefore, "A, B or C" means any of the following: "A; B; C; A and B; A and C; B and C; A, B and C". An exception to this definition will occur only when a combination of elements, functions, steps or acts are in some way inherently mutually exclusive.

Typically, theaters, auditoriums, and sports venues, e.g. stadiums, gymnasiums, field houses, etc., are fitted with seats joined together at their sides or bottoms to form longs rows of seats, referred to herein collectively as "stadium seats." Stadium seats have a seating member, a backrest member, and a supporting base, which is typically affixed to the floor. To facilitate movement of patrons in and out of their seats, stadium seats referred to herein are constructed so that the seating member can be folded toward the backrest member by pivoting on the supporting base when the seat is not occupied. In some cases, the backrest member and seating members of stadium seats are constructed of slats with gaps between the slats. In other cases, the backrest members and seating members are solid. Provided herein is a booster seat for a child or a small adult having embodiments and options suitable for use with either slatted-back stadium seats, solid back stadium seats, or both.

Figure 1B:
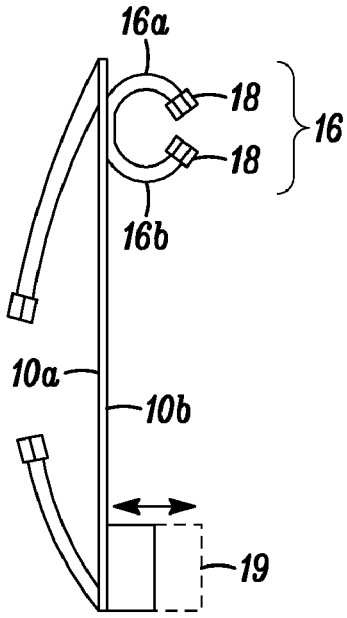
FIG. 1*b* shows a side view of the first embodiment seat.

FIGS. 1*a* and 1*b* show a first embodiment, seat 10, of the present invention. FIG. 1*a* depicts seat 10 laying flat with its back down and front facing toward the viewer while FIG. 1*b* depicts the right side view of FIG. 1*a*. In this embodiment, seat 10 is a substantially rectangular sheet of flexible material, such as fabric, netting, leather, or polymeric film, having a front 10*a*, a back 10*b*, a top 10*c*, a bottom 10*d*, a left side 10*e*, a right side 10*f*, a left, bottom corner 12*a* and a right, bottom corner 12*b*.

The bottom corners 12*a* and 12*b* are connected to their respective side, i.e., left side 10*e* and right side 10*f* (collectively, "the sides") at substantially the same distance from the bottom 10*d* by connecting means such as straps, ropes, wires, strips of leather, and strips of fabric, collectively referred to herein and illustrated in FIGS. 1*a* and 1*b* as "side straps" 14. One end of each of the side straps 14 may be attached to the sides, i.e., one end on each side as illustrated in FIGS. 1*a* and 1*b*, at any point in the range from about midway along each side to the top 10*c*. Preferably, the side straps 14 are attached to the sides about 10% to about 35% of the distance between the top 10*c* and the bottom 10*d* with respect to the top 10*c*. Also within the scope of the invention, the side straps 14 may be attached to the side by an adjustable means so that the user of the seat can choose the point of attachment of the side straps 14 to the sides. The other end of each of the side straps 14 is affixed to one of the bottom corners 12*a* and 12*b* as shown in FIGS. 1*a* and 1*b*.

While each of the side straps 14 may be a fixed length, preferably each is fitted with a means of easily adjusting its length. As illustrated in FIGS. 1*a* and 1*b*, each of the side straps 14 may be comprised of a set of two straps 14*a* and 14*b* that are joined preferably by a fastening means, such as a buckle 18 having a means of easily adjusting the length of the straps 14*a* and 14*b*.

Figure 1C:
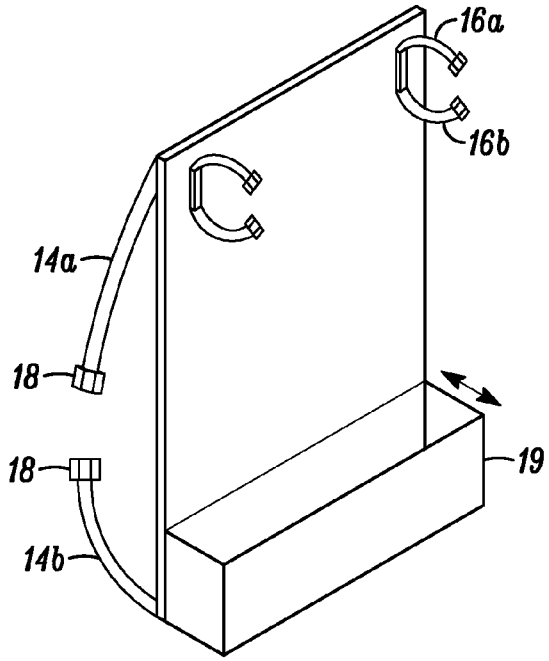
FIG. 1*c* is a perspective view of the back of the first embodiment seat.

Seat 10 may be connected to a slatted-back type stadium seat by connecting means such as straps, ropes, wires, and the like collectively referred to herein and illustrated in FIG. 1*b* as "back straps" 16. FIGS. 1*b* and 1*c* illustrates back straps 16 as being comprised of a set of two straps 16*a* and 16*b*. Seat 10 is fitted with at least two back straps 16 as illustrated in FIG. 3*c*. Typically, straps 16*a* and 16*b* are passed through adjacent openings between slats in the slatted-back stadium seat and joined by a fastener such as a buckle 18 or tied together, thus securing the top of the seat to the top of the backrest member of the slatted-back seat. Preferably, straps 16*a*, 16*b*, or both are fitted with a means of easily adjusting the length of the straps.

A sleeve 19 in the form of a pocket, substantially the width of the seat 10, is affixed to the back 10*b* along the edge of bottom 10*d* with the opening of the sleeve 10*a* facing toward the top 10*c*. The sleeve 19 is preferably fabricated from an elastic material that allows the sleeve 19 to expand or contract to snuggly fit around the front edge of the seating member of a stadium seat (i.e. the distal edge with respect to the backrest member). Further, a snug fit around the edge can be achieved by strapping with a means of adjustment such as a buckle or any suitable adjustment device of the art.

Figure 1D:
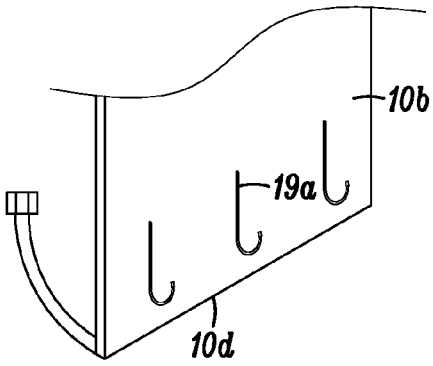
FIG. 1*d* shows an alternate way of using hooks to attach the bottom of the seat.

Alternatively, as shown in FIG. 1*d*, in place of sleeve 19 as the means of attaching seat 10 to the seating member of the stadium seat, one or more hooks 19*a* may be affixed to the back 10*b*, at the bottom 10*d*, of seat 10. Such hooks 19*a* are attached around the distal edge of the seating member in a way analogous to the attachment of sleeve 19. If only one hook is used, it is preferable that it be a relative wide hook, centered, and extending substantially the length of the bottom 10*d* of seat 10. If the seating member of the stadium seat is slatted, one or more set of straps 19*b*, see FIG. 1*e*, (including, but are not limited to, ropes, wires, strips of leather, and strips of fabric, collectively referred to herein as "straps") may be affixed to in place of sleeve 19 to a slat at the distal edge of the stadium seat. Such straps may be fastened by tying, buckling, and the like around the slat at the distal edge of the stadium seat in a way analogous to the attachment of straps 16 to a backrest member of a stadium seat described herein above.

Figure 1E:
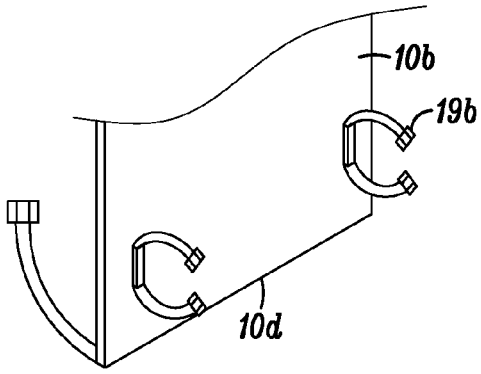
FIG. 1*e* shows an alternate way of using straps to attach the bottom of the seat.
Figure 1F:
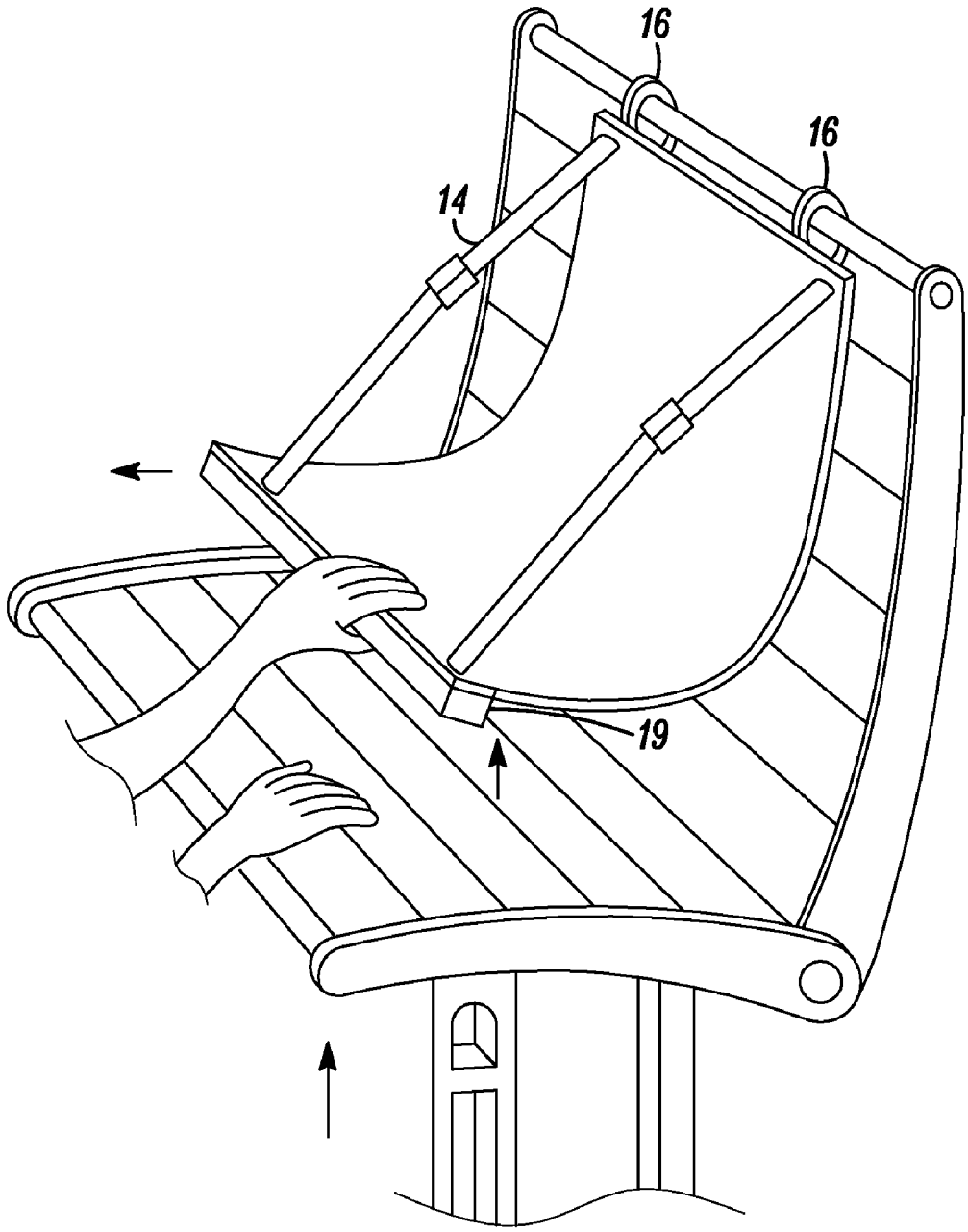
FIG. 1*f* shows the first embodiment seat attached to a slatted-back stadium seat and being pulled outward and upward for use.

FIG. 1*f* illustrates the seating member of the stadium seat being raised while seat 10, with its top attached to the backrest member, is being pulled outward so that sleeve 19 may be fitted over the edge of the seating member. The side straps are then adjusted to provide a pocket illustrated below in FIG. 3*b*.

Figure 2A:
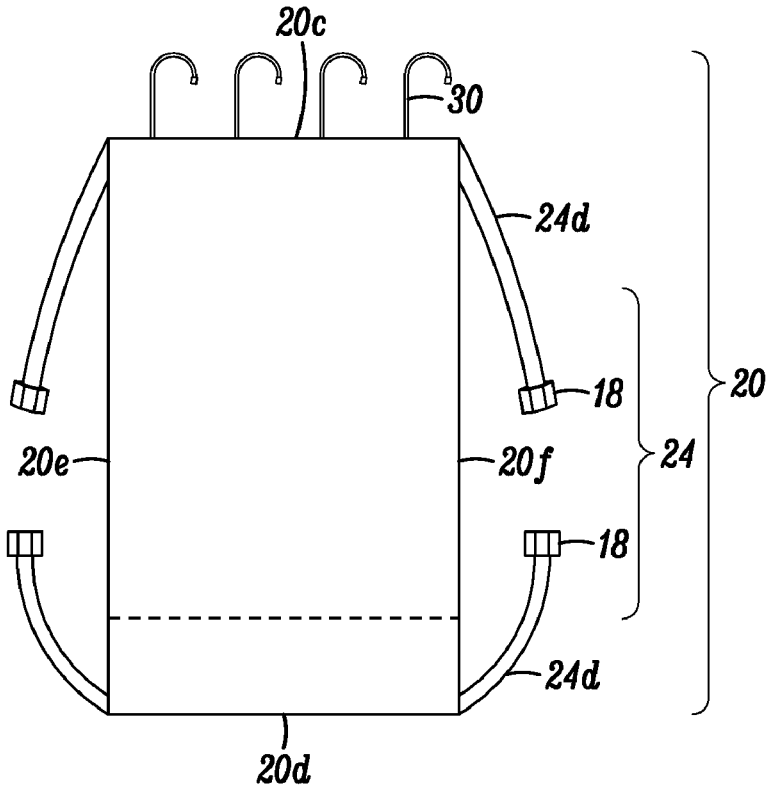
FIG. 2*a* shows the front of the second embodiment seat laying flat.
Figure 2B:
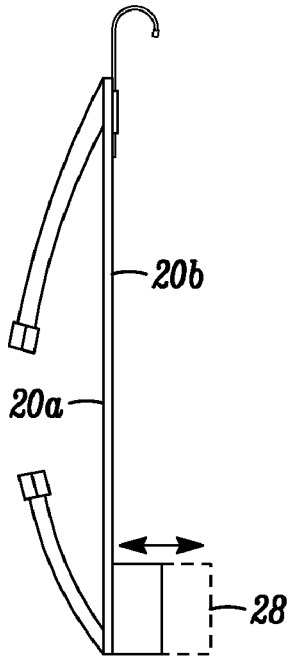
FIG. 2*b* shows the side view of the second embodiment seat.
Figure 2C:
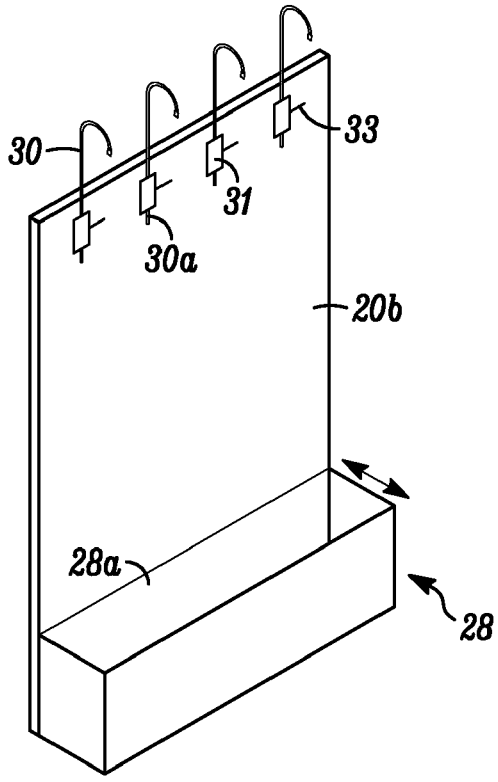
FIG. 2*c* is a perspective view of the back of the second embodiment seat.

FIGS. 2*a*-2*c* show a second embodiment of the seat of the present invention. FIG. 2*a* depicts the seat 20 that corresponds to seat 10 of FIGS. 1*a* and 1*b*. Note that the first and second embodiments differ in their means of attachment to the stadium seat and the two are substantially the same in other respects. Thus, with the exception of the means of attachment, the descriptions of the features of the second embodiment are substantially the same as for the corresponding features of the first embodiment. FIG. 2*a* shows seat 20 laying flat with its back 20*a* down and front 20*b* facing toward the viewer. In this embodiment, seat 20 is a substantially rectangular sheet of flexible material, such as fabric, netting, leather, or polymeric film, having a top 20*c*, a bottom 20*d*, a left side 20*e*, and a right side 20*f*.

FIG. 2*b* depicts the seat as viewed from its left side 20*e*. The top corners are joined to the respective bottom corners by side straps 24 which are similar in form and function to side straps 14 (shown if FIGS. 1*a* and 1*b*) of the first embodiment. Like the side straps 14, each side straps 24, may be comprised of two sections as shown in FIGS. 2*a*-2*c* and 3*b* as strap sections 24*a* and 24*b* that may be joined with an adjustable buckle 25 (or similar means known in the art) or a single strap having a means of adjusting its length. Seat 20 may optionally be fitted with a restrainer strap substantially the same as restrainer strap 22 of the first embodiment (see FIG. 1*a*).

A sleeve 28 (corresponding to sleeve 19 of the first embodiment shown in FIG. 1*c*) in the form of a pocket, substantially the width of the seat 20, is affixed to the back 20*b* along the edge of bottom 20*d* with the opening of the sleeve 28*a* facing toward the top 20*c*. The sleeve 28 is preferably fabricated from an elastic material that allows the sleeve 28 to expand or contract to snuggly fit around the front edge of the seating member of a stadium seat (i.e. the distal edge with respect to the backrest member). Further, a snug fit around the edge can be achieved by strapping with a means of adjustment such as a buckle or any suitable adjustment device of the art. Alternatively, hooks or straps may be employed in lieu of the sleeve in a manner analogous to that described above herein for the first embodiment as illustrated in FIGS. 1*d* and 1*e*.

A means of attaching the top of the seat 20 to the top of the backrest member of a stadium seat is affixed to the top of seat 20. Conveniently, this means of attachment may be one or more hooks 30 or similar devices on the back 20*b*, at the top 20*c*, as shown in FIGS. 2*a*-2*c*. Observe that corresponding seat 10 of the first embodiment attaches to the backrest member of a stadium seat with two or more sets of straps.

FIG. 2*c* is a perspective view of the back of seat 20 more clearly showing the open 28*a* of sleeve 28, and hooks 30. For this illustration, four hooks are shown but the number of hooks may be one or more. If only one hook is used, it is preferable that it be a relatively wide hook, centered and extending substantially the length of the top 20*c*of seat 20.

FIG. 2*c* also illustrates that the hooks 30 may be affixed to seat 20 by an adjustable means to allow the hooks to be moved individually to conform to any curvature in the top of the stadium seat to which seat 20 is attached. Such a means of adjustment may be sleeves 31 affixed to the back of seat 20 through which the hook shanks 30*a* may pass freely but having a locking device 33 to lock the hooks 30 in desired positions. The hooks 30 may be attached by a means that also allows detachment of the hooks 30.

Figure 3A:
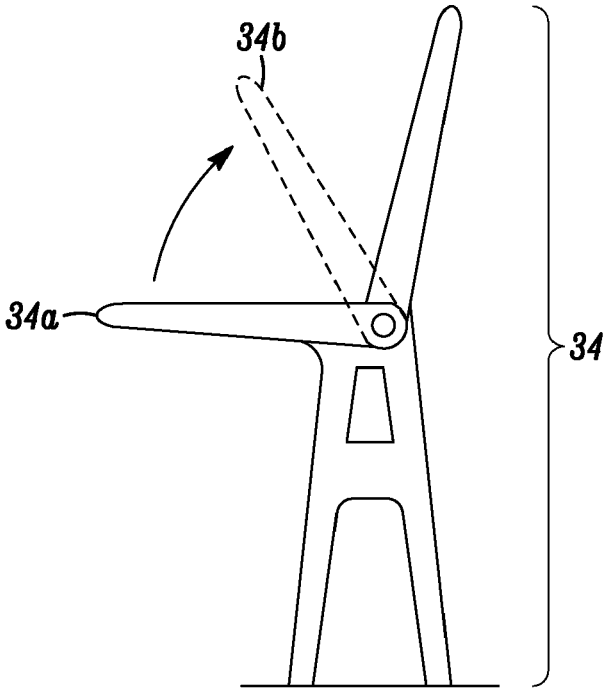
FIG. 3*a* shows a side view of a typical stadium seat with a movable seating member.
Figure 3B:
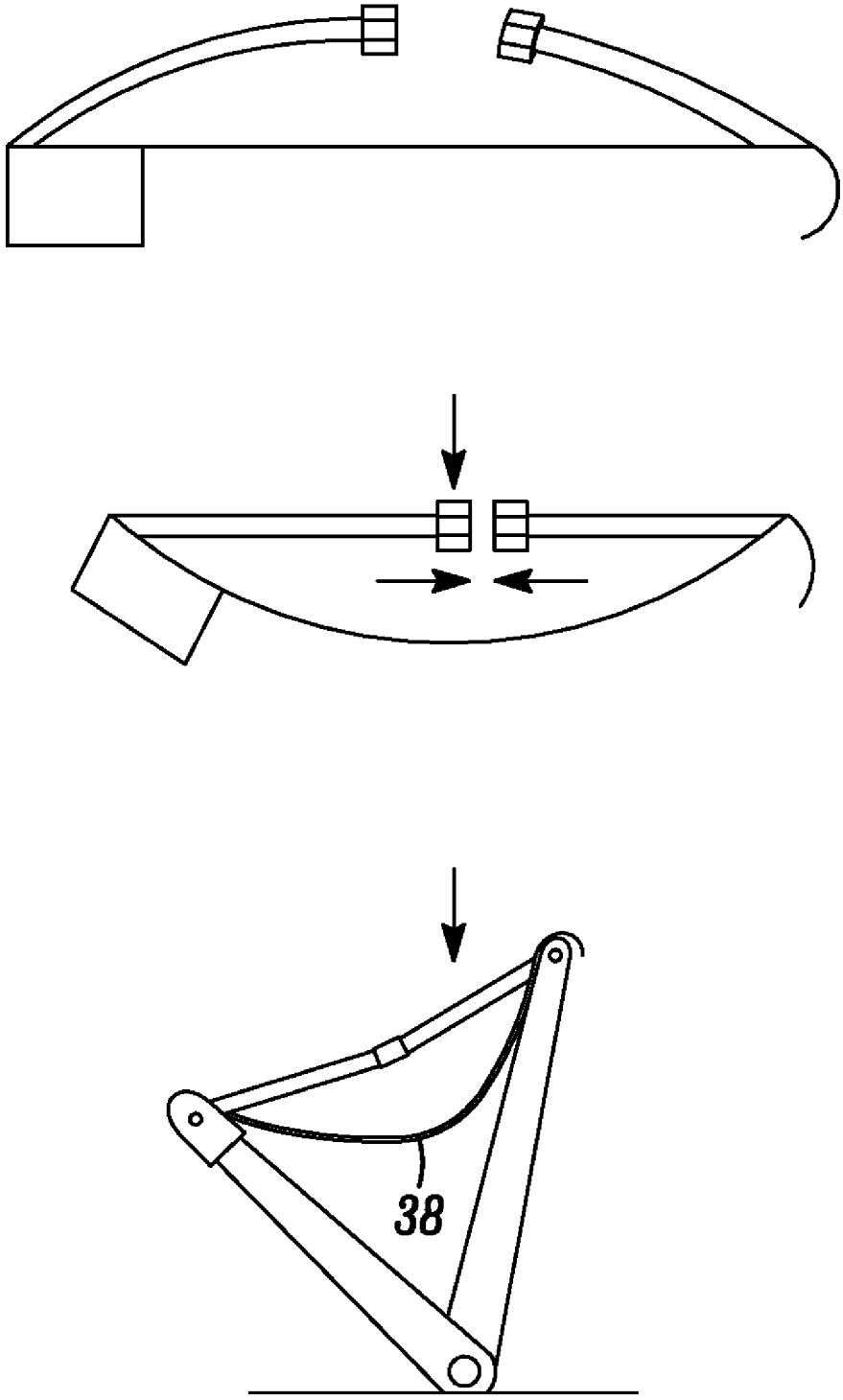
FIG. 3*b* shows by steps the installation of the second embodiment seat in a typical stadium seat.
Figure 3C:
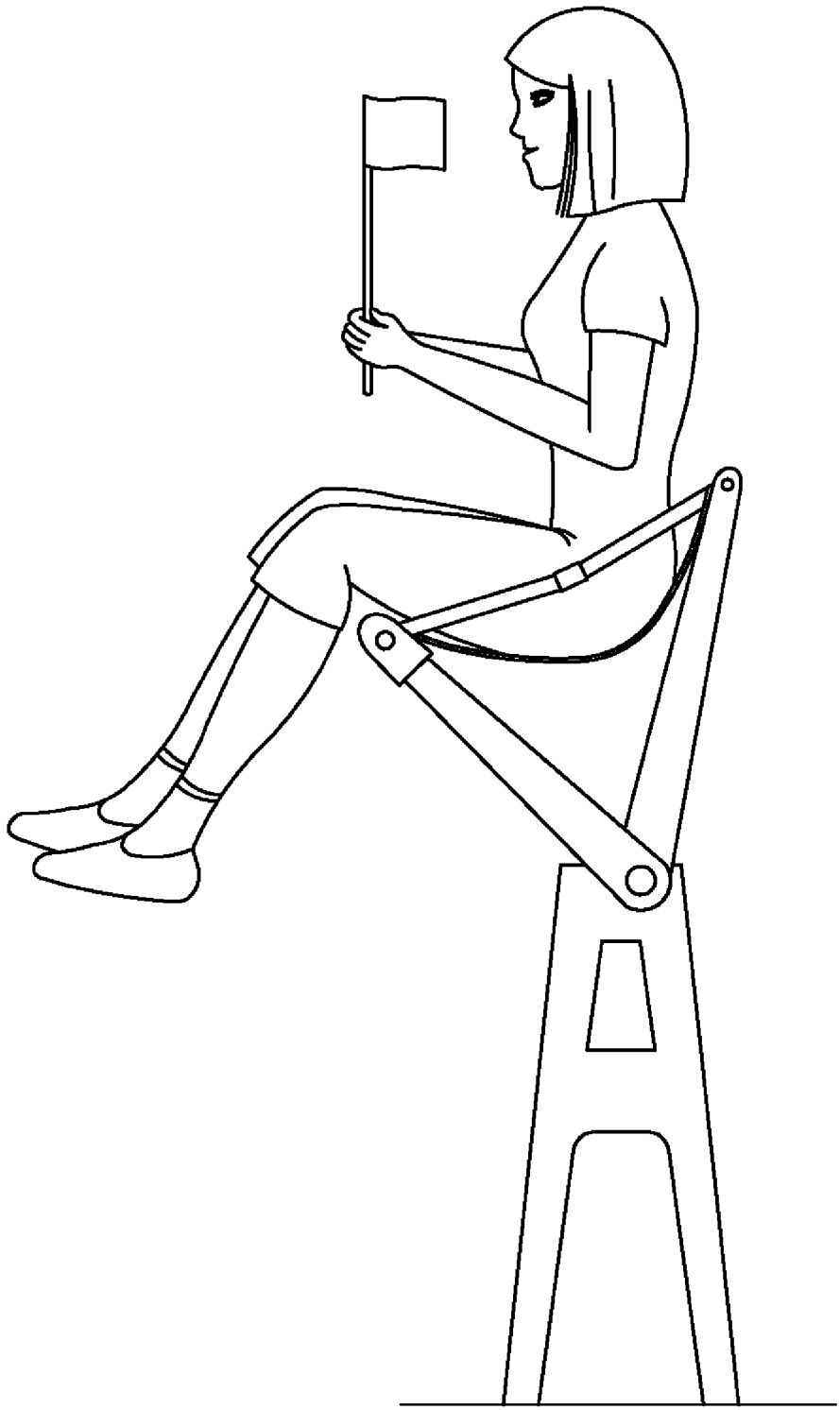
FIG. 3*c* shows a side view of the first embodiment seat attached to a stadium seat and being used by a child.

FIG. 3*a* shows a side view of a typical stadium seat 34 that has a seating member that can pivot from a "down" position 34*a*, for use, to an "up" position 34*b* when not in use. Both embodiments of the present booster seat are particularly suited for employment with this type of stadium seat with its seating member in the up position 34*b*. FIG. 3*b* is a perspective view of the present booster seat 10 with its top affixed to slatted backrest member of a slatted-back stadium seat. Although not expressly illustrated, the skilled artisan will recognize from the foregoing teaching, seat 20 would be applicable if the stadium seat back were not slatted.

As the bottom 10*d* or 20*d*, referring to the first and second embodiments respectively, is moved away from, the backrest member 36 of the slatted-back stadium seat, a fold, i.e., a pocket 38 is created in which a child may sit. The height to which pocket 38 is elevated above the seating member of the stadium seat may be altered by raising or lowering the point at which the back straps 16 are affixed to the backrest member of the slatted-back seat, or by adjusting the length of side straps 14, or both.

Optionally, Seat 10 and seat 20 may be fitted with a seat belt such as that shown if FIGS. 1*a* and 1*a* as restrainer strap 22. There may be occasions when the child must be removed very quickly form the seat to prevent injury. For example, at a baseball game, a child would need to be jerked to safety if a foul ball was headed toward the child. Therefore, if the optional restrainer strap 22 is employed, it must have a means of being quickly released. For example, the strap may be made of two parts fastened with a hook and fabric system such as the Velcro (trademark) fastening system.

The present booster seat in each embodiment may be rolled or folded to facilitate carrying it. For example, seat 10 or seat 20 may be rolled with back straps 16 facing outward so that they may be use to fasten seat 10 or seat 20 to a person's belt, purse straps, or similar items for hands-free carrying.

Additionally, a panel of flexible material may be attached to the top 10*c* or 20*c* and draped over the back of the seat (not shown in the figures). The additional panel might be imprinted with an advertisement, expression, or team logo. For example, a business may wish to promote its enterprise by giving to patron's child seats of the present invention imprinted with its commercial message.

The flexible material, which comprises the present booster seat, may be any material used in the art for making seating, harnesses, and the like. It could be used for a child or small adult. Conveniently, fabric, netting, leather, polymeric film or combinations thereof may be used so long as the material is sufficiently strong to safely support the user. Preferably the material is lightweight, water resistant, and easily cleaned. For example, nylon and light canvas fabrics are suitable for the seat. Conveniently, the seat is substantially rectangular, but other shapes such as oval and "hourglass" are within the scope of the present invention. The exact shape and proportions may vary depending on the weight and size of the child, which the seat must accommodate. For example, a small seat would be suited to a toddler, but an older child would require a larger and stronger seat.

Typically, points of wear and stress may be reinforced and edges may be hemmed to prevent unraveling and minimize wear. Where hooks are used to attach the booster seat, preferably, those hooks are fitted with tip covers of rubber, plastic, or similar relatively soft material to prevent injuries to the users of the seat and damage to the stadium seat.

As noted above, the back straps 14, side straps 16 and retaining strap 22, collectively "straps", may be fabricated from ropes, wires, strips of leather, strips of fabric, and the like. Typically, straps of woven nylon, canvas, or leather may be used. The straps may be joined to the seat by any suitable means of the art including gluing, riveting, stitching or combinations thereof so long as the seat can support a child or adult. The ends of the straps not affixed to the seat may be joined with any suitable coupling device of the art, such as buckles, hook and fabric fasteners (e.g. Velcro (trademark) fasteners), snaps, ties, or combinations thereof so long as the seat can support a child or adult. Buckles of high strength polymer having an integrated means of adjustment (e.g. Fastex (trademark) buckles) are particularly convenient.

What is claimed is:

1. A non-freestanding booster seat and a stadium seat having a backrest member, a seating member that has an extended position and a folded position with respect to the backrest member and the seating member has a proximal edge and a distal edge with respect to the backrest member, wherein;

a) the booster seat comprises a substantially rectangular sheet of flexible material having a front surface, a back surface, a top, a bottom, a right side and a left side, a left top corner area and a right top corner area, and a left bottom corner area and a right bottom corner areas with respect to the front surface, wherein:

b) the back surface, at or near the top, is fitted with a means of attaching the sheet of flexible material to the backrest member of the stadium seat wherein the means of attachment passes over or through the backrest member of the stadium seat, c) the left and right bottom corner areas are each fitted with a means of attachment to the left and right top corner areas respectively to form a pocket formation parallel to the top and bottom of the sheet that functions as a seat suitable for a child, holds the sheet in the pocket formation, and prevents the stadium seat from moving from the folded position to the extended position during use and prevents the stadium seat from moving from the folded position to the extended position, and d) the back surface, at the bottom, is fitted with a means of attaching the sheet of flexible material to the distal edge of the seating member of the stadium seat when the stadium seat is in a folded position wherein the arrangement of elements of the seat is such that the child is supported by suspending the child on the rectangular sheet between the distal end of the seat in the folded position and the backrest when sitting in the seat positioned on a stadium seat.

2. The booster seat of claim 1 wherein the means of attaching the back surface of the sheet of flexible material to the backrest member of a stadium seat having a slatted backrest member comprises one or more straps, ropes, or wires affixed to the back of the sheet, and the means of attachment of the corners to the sides of the sheet are selected from flexible straps, ropes, and wires; and side panels.

3. The booster seat of claim 1 wherein the means of attaching the sheet of flexible material to the backrest member comprises one or more hooks affixed to the top of the back of the booster seat, wherein the hooks pass over the backrest member, and the means of attachment of the corners to the sides of the sheet are selected from flexible straps, ropes, and wires; and side panels.

4. The booster seat of claim 3 wherein each hooks attached to the sheet is independently adjustable.

5. The booster seat of claim 1 wherein the means of attaching the sheet of flexible material to the distal edge of the seating member comprises a sleeve attached to the back surface at the bottom of the sheet, wherein the sleeve is capable of fitting around the distal edge of the seating member when the stadium seat is in a folded position.

6. The booster seat of claim 1 wherein the means of attaching the sheet of flexible material to the distal edge of the seating member comprises one or more hooks affixed to the back of the sheet, wherein the hooks are capable of fitting around the distal edge of the seating member when the stadium seat is in a folded position.

7. The booster seat of claim 1 wherein the means of attaching the sheet of flexible material to the distal edge of the seating member, wherein the seating member is slatted, comprises one or more straps, ropes, or wires affixed to the back of the sheet, wherein the straps, ropes, or wires are capable of fitting around and joined to a slat at the distal edge of the seating member when the stadium seat is in a folded position.

8. The booster seat of claim 1 wherein the sheet of flexible material is selected from fabric, netting, leather, and polymeric film or combination thereof.

9. The booster seat of claim 1 wherein the means of attachment of the bottom corners to their tops each has a means of adjustment.

10. The booster seat of claim 9 wherein straps are the means of attachment and buckles are the means of adjustment of the straps.

* * * * *